US006155884A

United States Patent [19]

Sugiyama

[11] Patent Number: 6,155,884

[45] Date of Patent: Dec. 5, 2000

[54] CONNECTOR RETAINING CONSTRUCTION

[75] Inventor: Osamu Sugiyama, Shizuoka, Japan

[73] Assignee: Yazaki Corporation, Tokyo, Japan

[21] Appl. No.: 09/260,609

[22] Filed: Mar. 2, 1999

[30] Foreign Application Priority Data

Mar. 4, 1998 [JP] Japan ..... 10-052439

[51] Int. Cl.[7] ..... H01R 13/502

[52] U.S. Cl. ..... 439/701; 439/902; 439/903

[58] Field of Search ..... 439/701, 468, 439/466, 752

[56] References Cited

U.S. PATENT DOCUMENTS

| | | | |
|---|---|---|---|
| 3,657,682 | 4/1972 | Iversen | 339/103 M |
| 3,781,760 | 12/1973 | Mancini et al. | 339/59 M |
| 4,127,315 | 11/1978 | McKee | 339/103 B |
| 4,130,330 | 12/1978 | Chandler | 339/75 M |
| 4,195,899 | 4/1980 | Radloff et al. | 339/103 M |
| 4,239,320 | 12/1980 | Hesse et al. | 339/154 A |
| 4,413,875 | 11/1983 | Mattingly | 339/217 R |
| 4,483,580 | 11/1984 | Pelczarski | 339/103 M |
| 4,923,310 | 5/1990 | Sekiguchi et al. | 439/701 |
| 5,076,802 | 12/1991 | Colleran et al. | 439/468 |
| 5,271,739 | 12/1993 | Denlinger et al. | 439/466 |
| 5,282,760 | 2/1994 | Aimasso | 439/752 |
| 5,725,397 | 3/1998 | Fukamachi et al. | 439/701 |
| 5,947,762 | 9/1999 | Katsuma | 439/468 |

FOREIGN PATENT DOCUMENTS

| | | | |
|---|---|---|---|
| 0 557 976 A2 | 9/1993 | European Pat. Off. . | |
| 0 722 203 | 7/1996 | European Pat. Off. | H01R 13/629 |
| 8-50952 | 2/1996 | Japan . | |

*Primary Examiner*—Steven L. Stephan
*Assistant Examiner*—Amir M Abdulmelik
*Attorney, Agent, or Firm*—Sughrue, Mion, Zinn Macpeak & Seas, PLLC

[57] ABSTRACT

A connector retaining construction in which retaining claws for retaining connectors in a holder member will not interfere with an external member, and are prevented from damage due to such interference. In the construction, connectors (31, 32), having terminals inserted and retained therein, is inserted into a holder member (11) through an opening (18) of the holder member (11), and the connectors (31, 32) are slid, with elongate guide projections (42) of the connector (31, 32) engaged respectively with guide rails (19) formed on the holder member (11), thereby retaining the connector (32) in the holder member (11). A retaining step portion (44) is formed at each of the elongate guide projections (42) of the connector (32). An elastically-deformable retaining claw (22) for engagement in the associated retaining step portion (44) is disposed along each of the guide rails (19), The retaining claw having such a width that it will not project outwardly from the guide rail (19).

11 Claims, 6 Drawing Sheets

CONNECTOR RETAINING CONSTRUCTION

BACKGROUND OF THE INVENTION

1. Field of the Invention

The present invention relates to a connector retaining construction for holding or retaining connectors, each having terminals received therein, on a holder member such as a cover.

The present application is based on Japanese Patent Application No. Hei. 10-52439, which is incorporated herein by reference.

2. Description of the Related Art

FIGS. 6 and 7 show a connector retaining construction for holding a plurality of connectors on a holder member. The connector retaining construction is disclosed in Unexamined Japanese Patent Publication No. 8-50952.

In FIGS. 6 and 7, the holder member 1 has a downwardly-open, channel-shaped cross-section, and also has an open right end 1*a*, and connectors 2 and 2 can be inserted into the holder member through this open end 1*a*. Guide grooves 3*a* for guiding the sliding movement of the connectors 2 and 2 are formed respectively in opposed side walls 3 and 3 (opposed to each other in a forward-backward direction) of the holder member 1.

The holder member 1 further includes a retainer plate 4 for preventing the withdrawal of the inserted connectors 2 and 2. The retainer plate 4 is connected to one side wall 3 of the holder member 1 through a thin hinge 4*a*, and a lock piece portion 4*b* of a generally hook-shape is formed on a free end of the retainer plate 4. The lock piece portion 4*b* can be engaged with a lock projection 3*b*, formed on the other side wall 3, to hold the retainer plate 4 in a closed condition as shown in FIG. 7B.

Terminals (not shown), connected respectively to wires, are inserted and retained in each of the connectors 2, 2. Guide projections 5*a* are formed on each of opposite side walls 5 and 5 of each connector 2 at an upper portion thereof, and are adapted to be engaged in the associated guide groove 3*a* in the holder member 1 for sliding movement therealong.

In this construction, the retainer plate 4 is held in an open condition as shown in FIG. 6A, and in this condition, each connector 2 is inserted into the holder member 1 through the open end 1*a* thereof, so that the guide projections 5*a* of the connector 2 are engaged in the guide grooves 3*a* in the holder member 1, and the connector 2 is slid in this engaged condition. The connectors 2 are pushed into the holder member 1 as shown in FIG. 7A. Then, the retainer plate 4 is pivotally moved about the hinge 4*a*, so that the lock piece portion 4*b* is engaged with the lock projection 3*b* to retain the retainer plate 4 in the closed condition, thereby preventing the withdrawal of the connectors 2 as shown in FIGS. 6B and 7B. The holder member 1 has an increased height, and when the connectors 2 are received in the holder member, a space 7 is formed above the connectors 2 as shown in FIG. 6B. The wires (not shown), extending from the connectors 2 and 2, are received in this space 7.

In the above construction, the retainer plate 4 for preventing the withdrawal of the connectors 2 is pivotally connected to the holder member 1 through the hinge 4*a*, and therefore the amount of exposure of the retainer plate 4 is large. In the closed condition of the retainer plate 4, the lock piece portion 4*b* is engaged with the lock projection 3*b* projecting outwardly from the holder member 1, and therefore the amount of projecting of these lock portions is large. Therefore, not only at the time of insertion of the connectors 2 but also after the insertion of the connectors, the retainer plate 4 is liable to interfere with an external member, which results in problems that the retainer plate 4 can be damaged and that the retainer plate 4 can be unlocked. There has been encountered another problem that when unlocking the retainer plate 4, an undue force can act on the lock piece portion 4*b* to damage the lock piece portion 4*b*.

SUMMARY OF THE INVENTION

In order to eliminate the above-described problems, it is therefore an object of this invention to provide a connector retaining construction in which when inserting and retaining connectors in a holder member, a retainer member for effecting the retaining operation will not interfere with an external member so as not to be damaged, and when canceling the locked condition of the retainer member, the retainer member will not be damaged.

To achieve the above object, according to the first aspect of the present invention, there is provided a connector retaining construction which comprises: a holder member including an opening at an end portion thereof, and at least one guide rail; a connector insertable into the holder member through the opening, the connector including at least one elongate guide projection, wherein the connector is slid into the holder member while the elongate guide projection is engaged with the guide rail; a retaining step portion formed on the elongate guide projection; and an elastically-deformable retaining claw disposed along the guide rail, the retaining claw being located inside of an outside surface of the guide rail, wherein the retaining claw is engaged with the retaining step portion in order to retain the connector in the holder member.

In accordance with the above construction, the elongate guide projection of the connector is engaged with the guide rail of the holder member, and the guide rail and the elongate guide projection guide the sliding movement of the connector. In this sliding movement, when the retaining step portion of the elongate guide projection reaches the retaining claw of the guide rail, the retaining claw is engaged in the retaining step portion, thereby retaining the connector in the holder member. Therefore, merely by inserting the connector into the holder member and then by sliding the connector, the connector can be inserted and retained in the holder member, and the operability is enhanced.

The retaining claw for retaining the connector has such a width that it will not project outwardly from the guide rail, and therefore the retaining claw will not interfere with an external member before and after the sliding movement of the connector, and the retaining claw will not be damaged, and will not be accidentally brought out of the retained condition.

The retaining claw can be easily elastically displaced, and therefore can be easily brought out of engagement with the retaining step portion because of this elastic displacement. Therefore, the retained condition of the connector can be easily canceled. And besides, the retaining claw can be easily restored into its original position because of its elasticity, and can be re-used.

According to the second aspect of the present invention, it is preferable that the holder member includes at least one through window formed in that portion of a wall portion of the holder member opposed to the retaining claw, and the retaining claw has an insertion portion inserted in the through window.

In the construction according to the second aspect of the present invention, the insertion portion of the retaining claw is inserted in the through window in the holder member, and therefore the displacement of the retaining claw is limited to within a predetermined range. Therefore, even when the retaining claw is displaced in a direction out of retaining engagement with the retaining step portion, the retaining claw will not be excessively displaced, and damage to the retaining claw due to its excessive displacement will not occur.

According to the third aspect of the present invention, it is preferable that the holder member includes a stopper for stopping the connector at an end of a sliding movement of the connector.

In the construction according to the third aspect of the present invention, the stopper stops the sliding movement of the connector, and therefore the connector will not be slid excessively, and the operability in the retaining of the connector in the holder member is enhanced.

DETAILED DESCRIPTION OF THE PREFERRED EMBODIMENT

Figure 1:
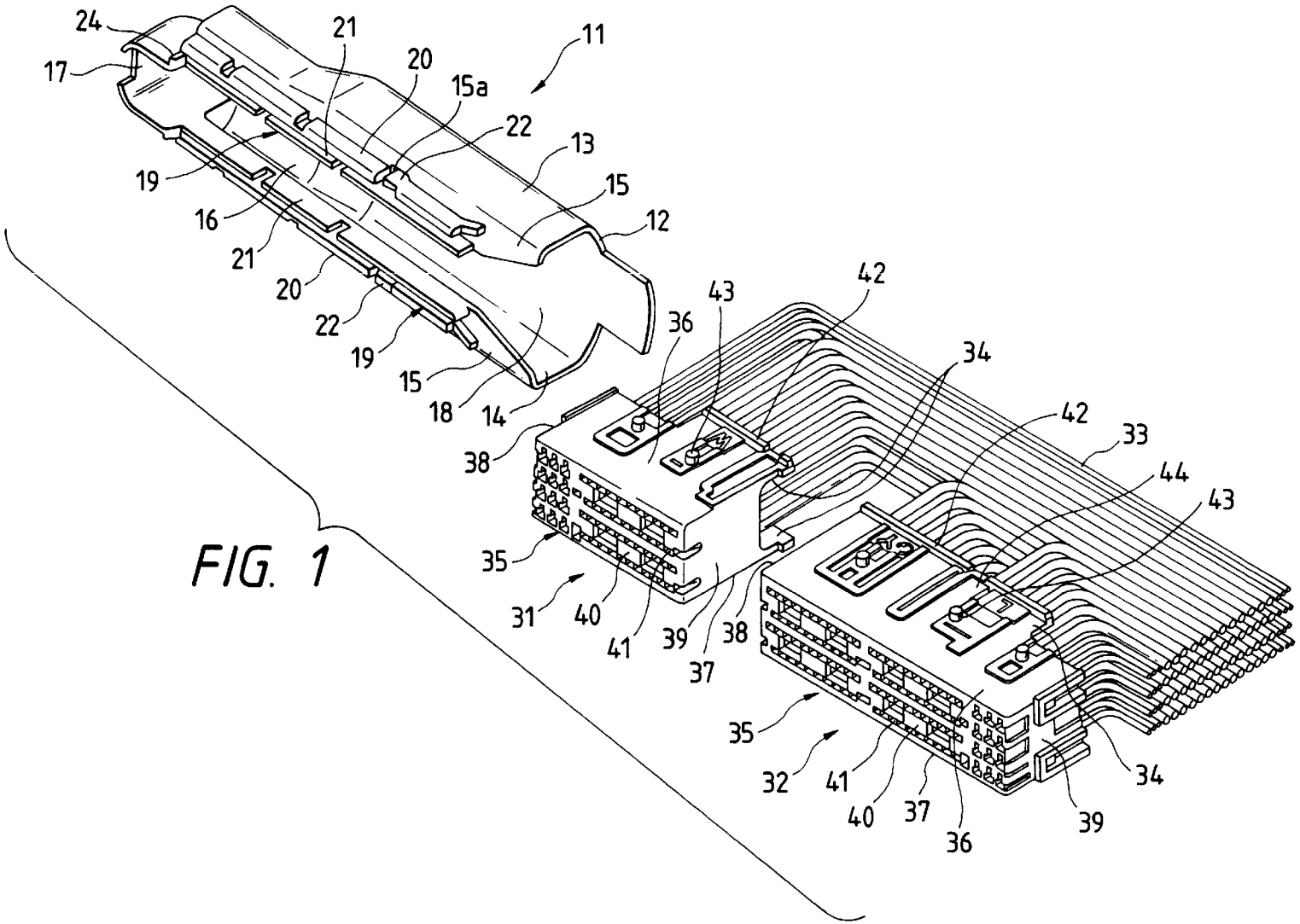
FIG. 1 is an exploded, perspective view of one preferred embodiment of a connector retaining construction of the present invention.
Figure 2:
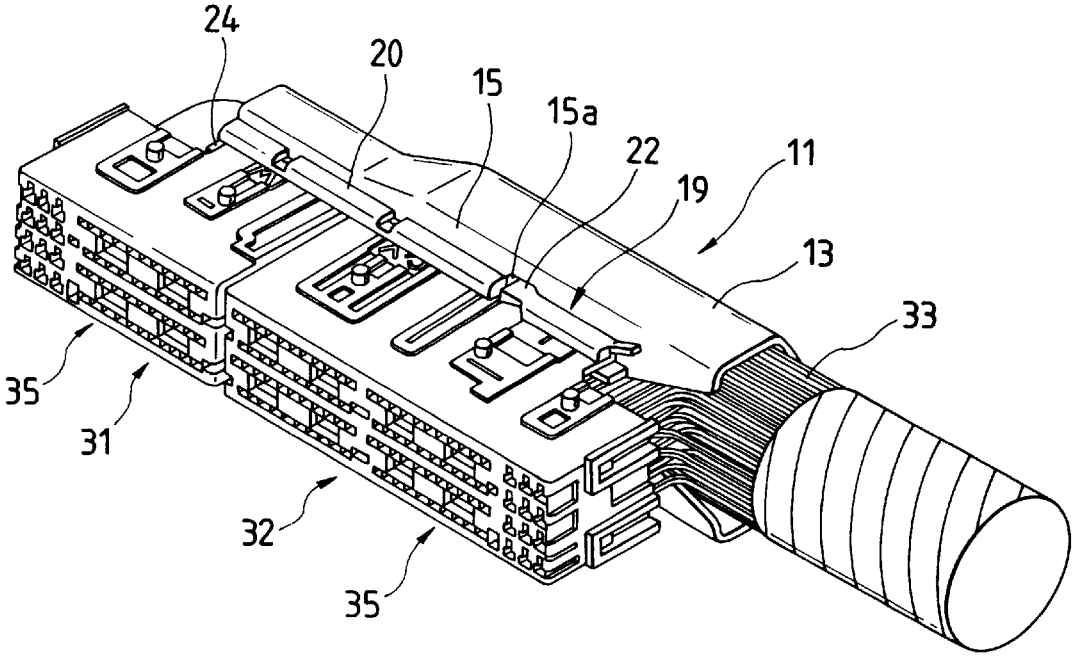
FIG. 2 is a perspective view of the construction of the above embodiment in an assembled condition.

FIG. 1 is an exploded, perspective view of one preferred embodiment of the present invention, and FIG. 2 is a perspective view of this embodiment in an assembled condition. In this embodiment, two male connectors 31 and 32 are inserted and retained in a holder member 11 in a juxtaposed manner.

The holder member 11 holds the connectors 31 and 32, and also serves as a cover for bundling and receiving a plurality of wires 33 extending from the connectors 31 and 32. The holder member 11 is molded entirely of a synthetic resin, and is formed into a generally tubular shape. This holder member 11 includes a rear wall 12, upper and lower walls 13 and 14 extending in a bent manner respectively from upper and lower ends of the rear wall 12 toward the front side, a front wall 15 extending downwardly from a distal end of the upper wall 13, and another front wall 15 extending upwardly from a distal end of the lower wall 14.

The front walls 15 and 15, extending respectively from the upper and lower walls 13 and 14, are so short that the front side of the holder member 11 has an opening. The connectors 31 and 32 can be withdrawn or removed forward through this opening 16. A side wall 17 is formed at a left end of the holder member 11, but no side wall is formed at a right end thereof, and therefore the holder member has the open right end (opening) 18. The connectors 31 and 32 are inserted into the holder member through this open right end 18.

Guide rails 19 and 19 are formed respectively on outer surfaces of the front walls 15 and 15 extending a short distance respectively from the upper and lower walls 13 and 14. The guide rail 19 on each of the two front walls 15 and 15 is formed by a pair of parallel, opposed guide plates 20 and 21. A lip portion 34 (more fully described later) of the connector 31, 32 is inserted between the pair of guide plates 20 and 21, and is slid along the guide rail 19.

The connector 31, 32 comprises a connector housing 35, and has the plurality of wires 33 extending outwardly from the connector housing 35. The connector housing 35 has a square box-like shape, and includes upper and lower walls 36 and 37, right and left walls 38 and 39, and a front wall 40, and has an open rear side. The connector housing 35 is molded entirely of a synthetic resin. A plurality of terminal insertion holes 41 each for inserting a mating terminal of a female connector (not shown) thereinto are formed in rows in the front wall 40, and a terminal receiving chamber (not shown) extends inwardly from each terminal insertion hole 41. Terminals (not shown) are inserted and retained in these terminal receiving chambers, respectively. The wires 33 are connected respectively to the terminals received respectively in the terminal receiving chambers, and extend outwardly from the rear side of the connector housing 35.

The lip portion 34 is formed integrally with and extends from the rear end of each of the upper and lower walls 36 and 37 of each connector housing 35, and an elongate guide projection 42 is formed on an outer surface of the lip portion 34. The elongate guide projection 34 is formed at the end portion of each lip portion 34, and extends straight in the direction of sliding movement of the connector 31, 32. The elongate guide projection 42 and the lip portion 34 are inserted between the pair of guide plates 20 and 21 of the associated guide rail 19 so as to guide the sliding movement of the connector 31, 32.

Guide pins 43 are formed on each of the upper and lower walls 36 and 37 of the connector housing 35 of the connector 31, 32. These guide pins 43 are used for drawing the connectors 31, 32 into the female connector.

In this embodiment, retaining claws 22 and a stopper 24 are further formed on the holder member 11, and retaining step portions 44 are formed at one connector 32.

Figure 3:
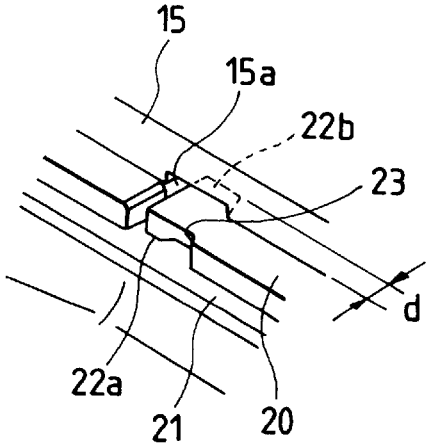
FIG. 3 is an enlarged, perspective view showing a retaining claw.

The retaining claw 22 is formed on one guide plate 20 of the guide rail 19, and is formed at an end of a transversely-interrupted portion of the guide plate 20 disposed intermediate the opposite ends thereof in its longitudinal direction. In this case, as shown in FIG. 3, a notch is formed in an outer edge of the guide plate 20 (that is, recessed in the widthwise direction from the outer edge toward the front wall 15) to form a step portion 23, and the retaining claw 22 is formed at that portion of the guide plate 20 having this step portion 23. Therefore, the retaining claw 22 is smaller in width than the guide plate 20, and hence will not project outwardly from the guide plate 20.

The retaining claw 22 has a retaining portion 22*a* slanting toward the other guide plate 21. This slanting retaining portion 22*a* is disposed closer to the other guide plate 21 than the one guide plate 20. With this construction, the retaining portion 22*a* of the retaining claw 22 is engaged in the retaining step portion 44 of the elongate guide projection 42 of the connector 32 slidable in the space formed between the guide plates 20 and 21.

In addition to the retaining claw 22, a through window 15*a* is formed in that portion of the front wall 15 of the holder member 11 opposed to the retaining claw 22, as shown in FIG. 3. The retaining claw 22 has an integral insertion portion 22*b* extending in a direction of an axis of the through window 15*a*, and this insertion portion 22*b* extends into the through window 15*a*. A length d of insertion of the insertion portion 22*b* into the through window 15*a* is equal to the thickness of the front wall 15 (of the holder member 11).

Figure 4A:
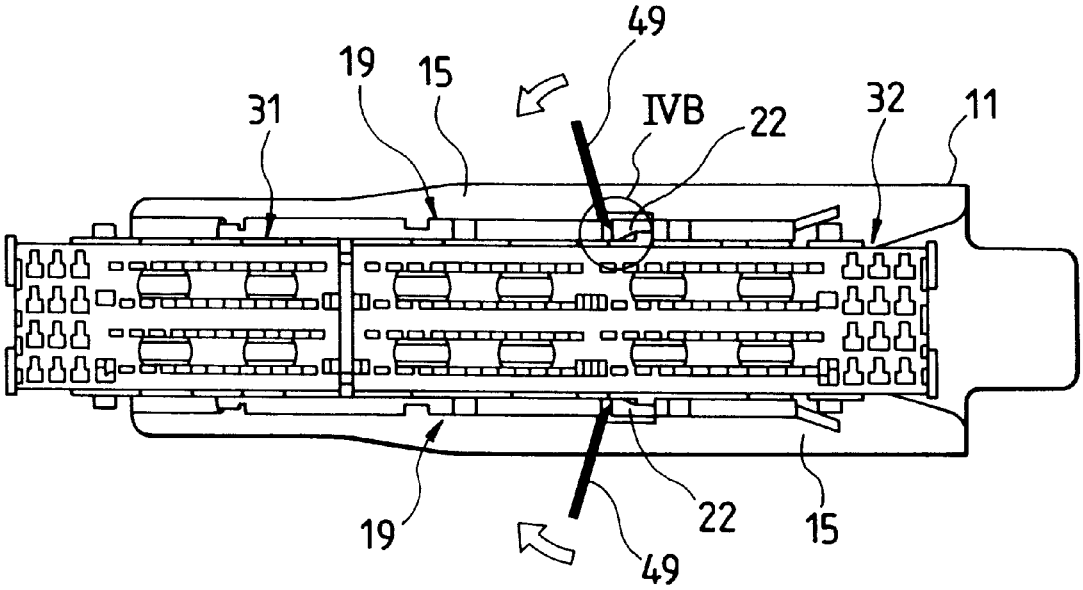
FIG. 4A is a front-elevational view showing an operation for canceling the engaged condition of the retaining claw.
Figure 4B:
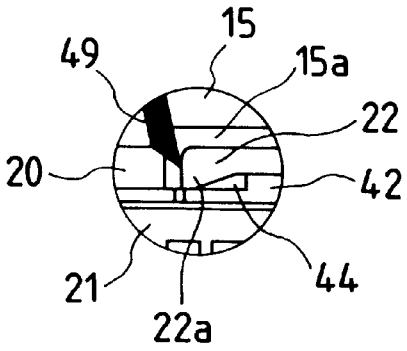
FIG. 4B is an enlarged view of a portion IVB of FIG. 4A.

In this construction, the retaining claw 22, having the insertion portion 22*b* inserted in the through window 15*a* in the front wall 15, is separate from the front wall 15 though the remainder of the guide plate 20 is formed integrally with the front wall 15. Therefore, the retaining claw 22 is elastically deformable in the direction of the thickness of the guide plate 20. And besides, the height of the through window 15*a* is slightly larger than the thickness of the retaining claw 22 as shown in FIG. 4B, and therefore the retaining claw 22 can be elastically deformed in a direction away from the other guide plate 21.

As shown in FIG. 1, the stopper 24 is formed on the left end wall 17 of the holder member 11. This stopper 24 is formed by bending the relevant portion from the rear end of the guide plate 21 of the upper front wall 15 toward the opening 16, and the connector 31, sliding in the opening 16, abuts against this stopper 24. The sliding movement of the connectors 31 and 32 is stopped by this abutment. Therefore, the connectors 31 and 32 will not be slid excessively, and the operability is enhanced.

The retaining step portion 44 are provided at the connector 32 which is inserted into the holder member 11 after the other connector. The retaining step portions 44 are formed by notching the upper and lower elongate guide projections 42 of the connector housing 35 of the connector 32, respectively, and the retaining portions 22*a* of the retaining claws 22 of the holder member 11 are engaged respectively in the retaining step portions 44. By this engagement, the connectors 31 and 32 are fixed and retained in their respective predetermined positions in the holder member 11.

Next, the assembling operation of this embodiment will be described. As shown in FIG. 1, the connectors 31 and 32, having the wires 33 extending outwardly therefrom, are juxtaposed to each other, and in this condition the two connectors are inserted into the holder member 11 through the opening 18. For effecting this inserting operation, each of the upper and lower lip portions 34 of each connector housing 35, as well as each of the upper and lower elongate guide projections 42, is inserted between the pair of guide plates 20 and 21 of the associated guide rail 19, and in this inserted condition the connectors 31 and 32 are slid. As a result of this sliding movement, the first-inserted connector 31 abuts against the stopper 24 to be stopped. With respect to the subsequently-inserted connector 32, the retaining step portions 44 are brought into registry with the retaining claws 22, respectively, and therefore the retaining claws 22 are engaged respectively in the retaining step portions 44 (see FIG. 4B), so that the sliding movement of this connector 32 is stopped. As a result of this engagement, the two connectors 31 and 32 are prevented from withdrawal from the opening 18. As a result of this sliding movement, the wires 33, extending outwardly from the connectors 31 and 32, are received in the holder member 11 along the length thereof, and the assembled condition, shown in FIG. 2, is achieved.

Figure 5A:
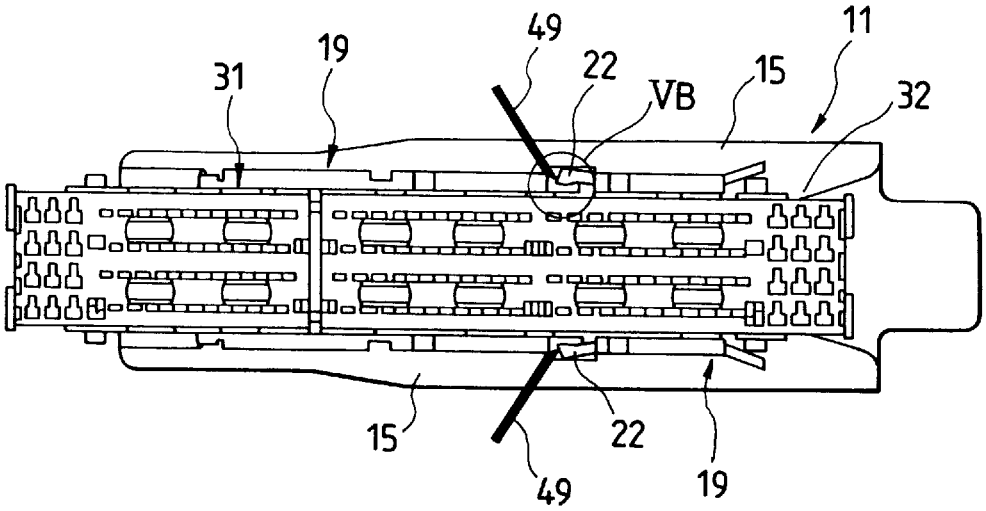
FIG. 5A is a front-elevational view showing the engagement-canceled condition of the retaining claw.
Figure 5B:
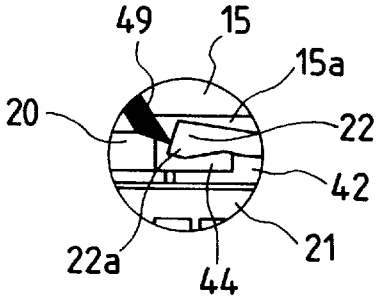
FIG. 5B is an enlarged view of a portion VB of FIG. 5A.

For removing the connectors 31 and 32 from the holder member 11, jigs 49 such as screw drivers are engaged with the distal ends of the retaining claws 22, respectively, and are tilted in directions of the arrows. By doing so, the retaining claw 22 is elastically deformed away from the guide plate 21 as shown in FIGS. 5A and 5B, and the retaining portion 22*a* of the retaining claw 22 is disengaged from the retaining step portion 44, thus canceling the engagement between the retaining claw 22 and the retaining step portion 44. Therefore, the connectors 31 and 32 can be withdrawn from the holder member 11.

Figure 5C:
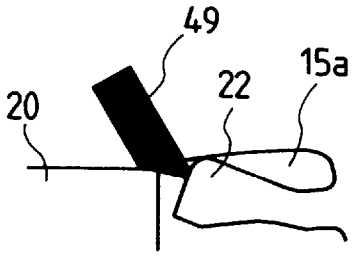
FIG. 5C is an enlarged view showing the prevention of excessive displacement of the retaining claw.
Figure 6A:
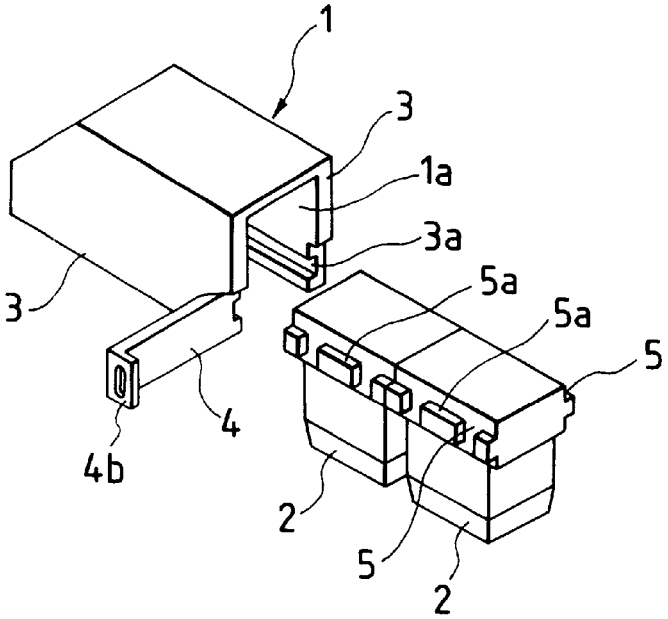
FIG. 6A PRIOR ART
FIG. 6A is an exploded, perspective view of a connector retaining construction.
Figure 6B:
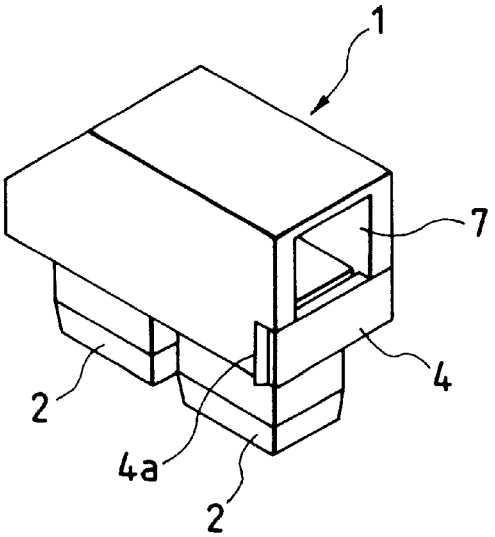
FIG. 6B PRIOR ART
FIG. 6B is a perspective view of the construction of FIG. 6A in an assembled condition.
Figure 7A:
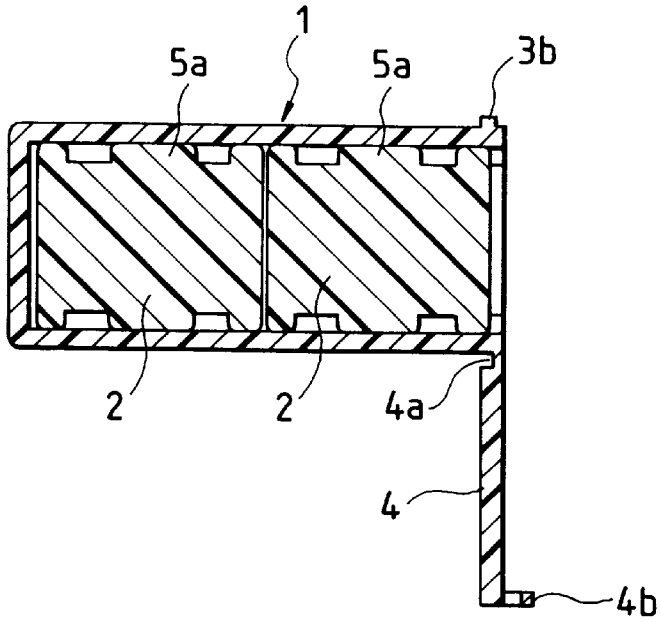
FIG. 7A PRIOR ART
FIG. 7A is a cross-sectional view of the construction of FIGS. 6A and 6B in a connector-inserted condition.
Figure 7B:
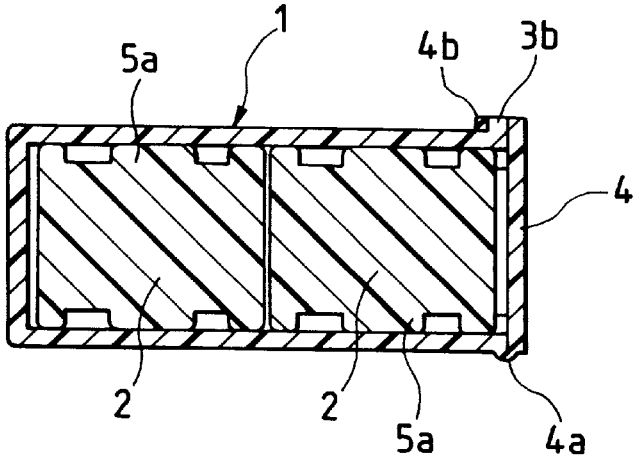
FIG. 7B PRIOR ART
FIG. 7B is a cross-sectional view of the construction of FIG. 7A in the assembled condition.

When the retaining claw 22 is elastically deformed, the insertion portion 22 of the retaining claw 22, inserted in the through window 15*a*, abuts against the upper surface of the through window 15*a*. Therefore, the retaining claw 22 will not be excessively displaced as shown in FIG. 5C, and damage to the retaining claw 22 due to its excessive displacement can be prevented.

In this embodiment, the retaining claws 22 are formed respectively on the guide rails 19 for guiding the sliding movement of the connectors 31 and 32, and therefore merely by sliding the connectors 31 and 32, the retaining claws 22 can be engaged in the retaining step portions 44, respectively. Therefore, merely by inserting the connectors 31 and 32 into the holder member 11 and then by sliding these connectors, the connectors can be retained in the holder member 11, and the operability is enhanced.

And besides, the retaining claw 22 has such a width that it will not project outwardly from the guide rail 19, and therefore the retaining claw 22 will not interfere with an external member before and after the sliding movement of the connectors 31 and 32, and the retaining claw 22 will not be damaged, and will not be accidentally brought out of the retained condition, and the connectors 31 and 32 can be fixed in a stable manner.

As described above, the retaining claw is formed at each of the guide rails for guiding the sliding movement of the connectors, and therefore merely by inserting the connectors into the holder member and then by sliding the connectors, the connectors can be retained in the holder member, and the operability is enhanced. The retaining claw has such a width that it will not project outwardly from the guide rail, and therefore the retaining claw will not interfere with an external member before and after the sliding movement of the connectors, and the retaining claw will not be damaged, and will not be accidentally brought out of the retained condition. And besides, by elastically displacing the retaining claw, the retaining claw can be brought out of retaining engagement with the connector, and therefore, the retained condition of the connector can be easily canceled.

Further, the insertion portion of the retaining claw is inserted in the through window in the holder member, and therefore the displacement of the retaining claw is limited to within the predetermined range, and therefore the retaining claw will not be excessively displaced, and damage to the retaining claw due to its excessive displacement will not occur.

Furthermore, the stopper stops the sliding movement of the connector, and therefore the connector will not be slid excessively, and the operability in the retaining of the connectors in the holder member is enhanced.

What is claimed is:

1. A connector retaining construction, comprising:

a holder member including an opening at an end portion thereof, and at least one guide rail;

a connector insertable into the holder member through the opening, the connector including at least one elongate guide projection, wherein the connector is slid into the holder member while the elongate guide projection is engaged with the guide rail;

a recessed retaining step portion formed on the elongate guide projection; and an elastically-deformable retaining claw disposed along the guide rail at an intermediate portion thereof, at an outside surface of the guide rail, wherein the retaining claw is engaged with the retaining step portion in order to retain the connector in the holder member.

2. The connector retaining construction of claim 1, wherein the holder member includes at least one through window formed in that portion of a wall portion of the holder member opposed to the retaining claw, and the retaining claw has an insertion portion inserted in the through window.

3. The connector retaining construction of claim 2, wherein the holder member includes a stopper for stopping the connector at an end of a sliding movement of the connector.

4. The connector retaining construction of claim 1, wherein the holder member includes a stopper for stopping the connector at an end of a sliding movement of the connector.

5. The connector retaining construction of claim 1, wherein the connector includes a terminal inserted and retained therein.

6. The connector retaining construction of claim 1, wherein the retaining claw is integrally formed on the guide rail in a cantilever-like manner.

7. A connector retaining constructions, comprising:

a holder member including an opening at an end portion thereof, and at least one guide rail;

a connector insertable into the holder member through the opening, the connector including at least one elongate guide projection, wherein the connector is slid into the holder member while the elongate guide projection is engaged with the guide rail;

a retaining step portion formed adjacent to the elongate guide projection; and a cantilevered-like retaining claw integrally formed on the guide rail, the retaining claw being located at an intermediate portion of the guide rail at an outside surface thereof, wherein the retaining claw is engaged with the retaining step portion in order to retain the connector in the holder member.

8. The connector retaining construction of claim 7, wherein the holder member includes at least one through window formed in that portion of a wall portion of the holder member opposed to the retaining claw, and the retaining claw has an insertion portion inserted in the through window.

9. The connector retaining construction of claim 8, wherein the holder member includes a stopper for stopping the connector at an end of a sliding movement of the connector.

10. The connector retaining construction of claim 7, wherein the holder member includes a stopper for stopping the connector at an end of a sliding movement of the connector.

11. The connector retaining construction of claim 7, wherein the connector includes a terminal inserted and retained therein.

* * * * *